US005381587A

United States Patent [19]

Vandergriff

[11] Patent Number: 5,381,587

[45] Date of Patent: Jan. 17, 1995

[54] COTTON GIN CONDENSER WITH HUMIDIFICATION AND BATT COMPRESSION

[75] Inventor: Arvel L. Vandergriff, Visalia, Calif.

[73] Assignee: Consolidated Cotton Gin Corporation, Lubbock, Tex.

[21] Appl. No.: 152,820

[22] Filed: Nov. 15, 1993

[51] Int. Cl.[6] ..... D01B 1/06; B01D 46/04

[52] U.S. Cl. ..... 19/48 R; 19/66 CC; 55/290

[58] Field of Search ..... 19/48 R, 99, 54, 66 R, 19/203, 250, 66 CC; 100/74; 193/11; 55/290, 283, 318

[56] References Cited

U.S. PATENT DOCUMENTS

| | | | |
|---|---|---|---|
| 2,867,851 | 1/1959 | Mitchell | 19/66 CC |
| 2,914,809 | 12/1959 | Buzick, Jr. | 193/11 X |
| 4,103,397 | 8/1978 | Jackson | 19/66 CC |
| 4,140,503 | 2/1979 | Vandergriff | 55/290 |
| 4,226,715 | 10/1980 | Niederer et al. | 55/290 X |
| 4,470,913 | 9/1984 | Kieronski | 55/290 X |
| 4,519,821 | 5/1985 | Weber et al. | 55/290 |
| 4,710,207 | 12/1987 | Bodovsky et al. | 55/290 |
| 4,999,881 | 3/1991 | Vandergriff | 19/48 R |

*Primary Examiner*—Clifford D. Crowder

*Assistant Examiner*—Ismael Izaguirre

*Attorney, Agent, or Firm*—Wendell Coffee

[57] ABSTRACT

The housing of a cotton gin lint condenser is divided into four segments, namely: the lint inlet segment, the moist air inlet segment, the doffing chamber segment, and the dry air inlet segment. In operation, as the drum rotates a cotton batt is formed in the lint inlet segment. The batt is rotated to the humid air inlet segment where moisture is added to the batt by passing warm humid air through the batt. The moisturized batt is then rotated to the doffing chamber segment where the batt is doffed from the drum. The drum is then rotated to the dry air segment where dry air removes the moisture from the drum. The warm moist air moves beneath the lint slide to warm the lint slide surface to maintain it in a dry condition so that the lint does not stick thereto. Compression rollers are contained within the doffing chamber segment. The compression rollers have about the same diameter as the doffing rollers to prevent excessive lint from sticking to them. The downstream doffing roller has flaps thereon which form air seals at the proper points and also wipe different surfaces to keep cotton lint from sticking to those surfaces. An air valve in the form of a flap, which is biased against the batt, separates the lint inlet segment from the moist air inlet segment.

19 Claims, 2 Drawing Sheets

COTTON GIN CONDENSER WITH HUMIDIFICATION AND BATT COMPRESSION

BACKGROUND OF THE INVENTION

1. Field of the Invention

This invention relates to cotton gins and more particularly to a lint condenser for forming a batt from lint carried in an airstream. Specifically, forming a batt suitable for baling in a high-speed baling press. A cotton gin operator has ordinary skill in this art.

2. Description of the Related Art

Lint condensers are well known in the cotton ginning art. It is also known that it is desirable to humidify the lint at the time of forming the batt and to compress the batt as an aid to feeding it to the baling press. For example, see the patent by A. L. VANDERGRIFF and CARL M. SMITH, U. S. Pat. No. 4,999,881 issued Mar. 19, 1991. (hereafter "The VANDERGRIFF and SMITH patent")

The VANDERGRIFF and SMITH patent also shows that it is known to the art to have a source of warm humid air and a source of warm dry air. It is desired that the warm humid air be no more than 140° F. dry bulb, and wet bulb temperature of about 130° F. When humidifying lint with warm humid air, often moisture will form upon metal parts causing the cotton to cling to the metal parts, particularly the doffing rollers, compression rollers, and lint slide.

SUMMARY OF THE INVENTION:

(1) Progressive Contribution to the Art

This invention solves this problem by dividing the space between the housing and the condenser drum into four segments with air seals between the different segments. The air seals extend from the housing onto the condenser drum to separate the segments. Three of the areas have controlled air flows into the condenser drum and the fourth is controlled to have a neutral, or static air, or a lack of air flow to or from the drum. Specifically the segments are, the lint inlet, the humid air inlet, the doffing chamber, and the dry air inlet. The major source of airflow will be in the lint inlet. About 85% of the air entering the condenser drum will be the conveying air with the lint. About 8% of the air entering the drum will be humid air and about 7% will be warm dry air. The doffing section will be neutral, i.e., the cotton batt will be removed from the condenser drum but there will be negligible air flow to or from the drum at the doffing chamber.

The dry air inlet and lint inlet are separated by a fixed air seal approximately opposite the doffing chamber. The doffing chamber segment will have air seals formed by the doffing rollers on each side thereof. A pivoted or floating air valve will ride upon the batt between the humid air inlet and the lint inlet segments.

The lint inlet will be defined by the stationary or fixed air seal between the housing and the condenser drum on the upstream side. The downstream side of the lint inlet will be defined by the floating air valve against the batt. The humid air inlet will be defined on the upstream side by the floating valve against the batt and on the downstream side by the smooth doffing roller and the batt of cotton between the doffing roller and the condenser drum. There will be a seal between the housing (the edge of the lint slide) and the smooth doffing roller. The doffing segment will be defined by the smooth doffing roller on the upstream side and the flexible flaps on the downstream side. The dry air segment will be defined by the flexible flaps of the doffer on the upstream side and by the fixed seal on the downstream side.

Warm dry air will dry the condenser drum to prevent an accumulation of moisture upon the condenser drum.

The compression rollers have a diameter approximately equal to the diameter of the doffing rollers. The compression roller diameter is larger than customarily used in the prior art. By the use of larger compression rollers, lint accumulation is controlled to a tolerable level. In addition, the flap doffing roller has flexible flaps which wipe against the smooth doffing roller and also wipe against the smooth compression roller, thereby preventing an accumulation of lint upon these elements. A ribbed or grooved compression roller operates with small clearances between the smooth doffing roller and also a delivery roller to minimize, if not eliminate, accumulation of lint upon this compression roller.

The VANDERGRIFF and SMITH patent taught the desirability of having a warm dry-air chamber beneath the lint slide to prevent an accumulation of moisture upon the lint slide. The location of the segments of the condenser housing result in the desirability of having a warm humid-air chamber operating to warm the lint slide.

(2) Objects of this Invention

An object of this invention is to condense a Lint cotton batt from an air-stream carrying lint cotton.

Another object of this invention is to humidify the batt.

A further object of this invention is to prevent the humidified batt from clinging to metal surfaces.

A further object of this invention is to compress the humidified batt into a smaller volume for easier handling in a lint slide to a baling press.

Further objects are to achieve the above with devices that are sturdy, compact, durable, lightweight, simple, safe, efficient, versatile, ecologically compatible, energy conserving, and reliable, yet inexpensive and easy to manufacture, install, operate, and maintain.

Other objects are to achieve the above with a method that is rapid, versatile, ecologically compatible, energy conserving, efficient, and inexpensive, and does not require highly skilled people to institute, and operate.

The specific nature of the invention, as well as other objects, uses, and advantages thereof, will clearly appear from the following description and from the accompanying drawings, the different views of which are not necessarily scale drawings.

Figure 1:
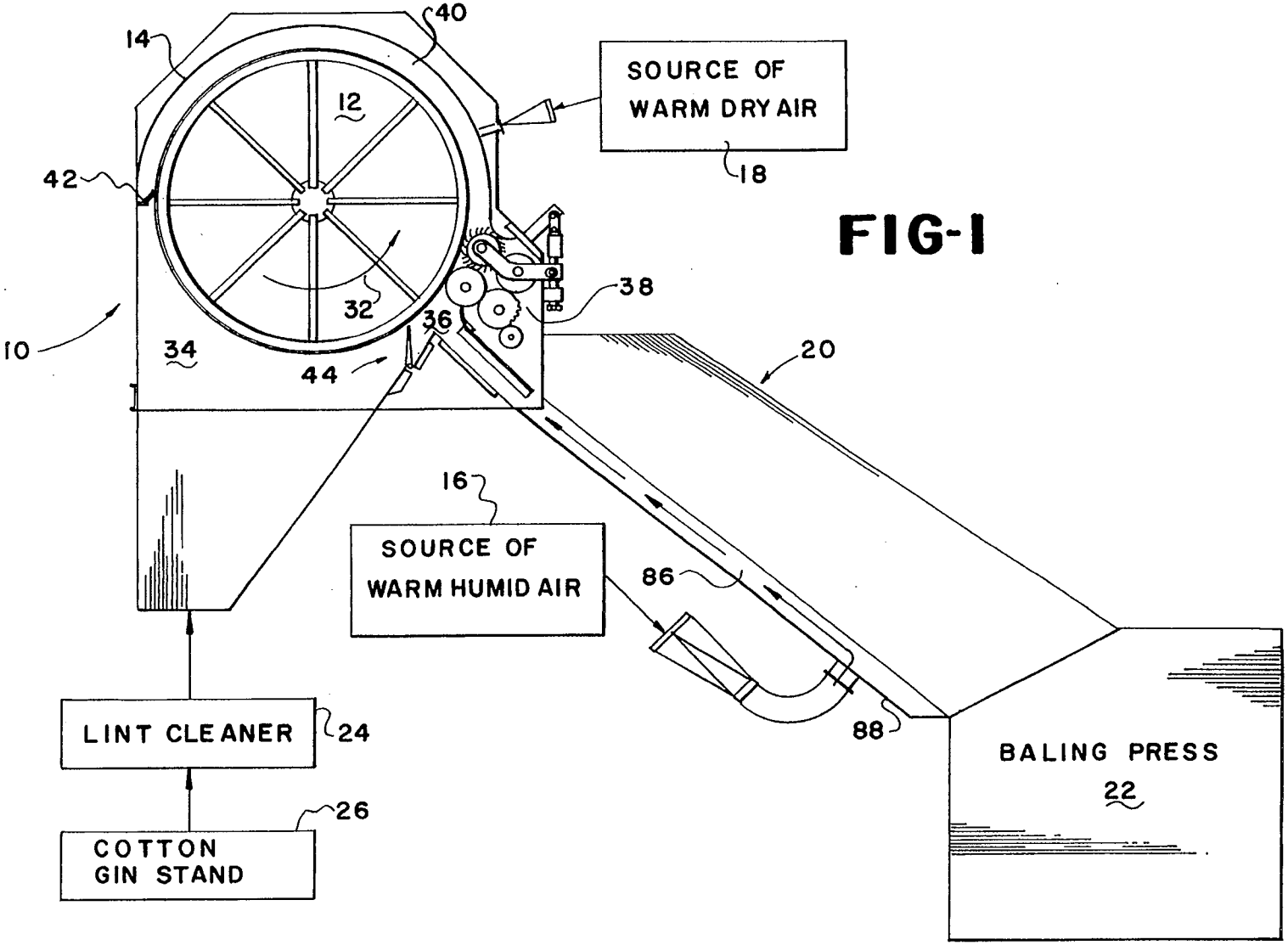
FIG. 1 is a drawing with schematic representation of some elements of an embodiment of this invention.

AS an aid to correlating the terms of the claims to the exemplary drawing(s), the following catalog of elements and steps is provided:

A angle
10 lint condenser
12 drum
14 housing
16 source of warm humid air
18 source of warm dry air
20 lint slide
22 baling press
24 lint cleaner 26 gin stands
28 metallic screen
30 shaft
32 rotation means
34 lint inlet
36 humid air inlet
38 doffing chamber
40 dry air inlet
42 fixed seal
44 air valve
46 valve element
48 valve shaft
50 distal edge
52 weight
54 arm
56 smooth doffing roller
58 air flap
60 lint slide surface
62 flap roller
64 plurality of flaps
66 housing portion
68 smooth compression roller
70 grooved compression roller
72 shaft
74 arm
76 shaft
78 fluid cylinder
80 leg
82 adjustable stop
84 delivery roller
86 lint slide air chamber
88 bottom

DESCRIPTION OF THE PREFERRED EMBODIMENTS(S)

Referring to the drawings there may be seen cotton gin lint condenser 10. The condenser has drum 12 and housing 14.

Other equipment associated with the lint condenser 10 will be source of warm humid air 16 and source of warm dry air 18. These two elements are normally in a single, unified system whereby the system can deliver a set quantity of air at the desired temperature and humidity. Units of this nature are well known to the art and therefore not further described.

The condenser 10 will feed a batt of cotton to lint slide 20 where the batt is fed to baling press 22. Baling presses are well known to the art and they will include elements for tramping the cotton, pressing the cotton, covering it with a protective covering and confining it with ties or bands, all well known to the art. As a part of the operation of the baling press there will be interruptions of the flow of cotton from the lower end of the lint slide 20 into the baling press 22. This is a partial reason for having the batt of cotton compressed from the lint condenser 10 so that the space and area for the lint slide is maintained at a minimum for the accumulation of the lint cotton during these interruptions of reception by the baling press 22. Those with ordinary skill in the art will recognize the baling press 22 is shown schematically.

The baling press will be the final operation of the processing of the lint cotton and the lint condenser to be the penultimate operation. The lint cotton will be supplied to the lint condenser in a stream of air from lint cleaner 24. The lint is supplied to the lint cleaner from cotton gin stands 26. The cotton gin stands are the well known cotton gin structure that separates the lint from the seed. The lint cleaner is the well known machine that cleans trash from the lint cotton.

The condenser drum 12 includes metallic screen 28 to permit the passage of air into the drum and form a batt of cotton lint on the exterior. In normal operation the interior of the drum will be connected to the intake side of a fan so that the interior is at slightly less than atmospheric pressure. The drum is mounted to rotate about shaft 30. Rotation means 32 for rotating the drum about the shaft 30 is schematically represented in the drawings by the arrow.

Those skilled in the art will recognize that the elements and their relationship as described to this point, to be old and well known in the cotton ginning art.

The interior of the housing 14 is divided into four segments: lint inlet 34; humid air inlet 36; doffing chamber 38; and dry air inlet 40.

Fixed seal 42 separates the lint inlet segment from the dry air inlet segment. It is not described in detail but only to say that it is basically a rubber flap fixed to the housing 14 approximately opposite to the doffing chamber. The rubber flap rides against the drum 12 and prevents the lint and the carrier air in the lint inlet from mixing with the dry air in the dry air inlet 40.

Figure 2:
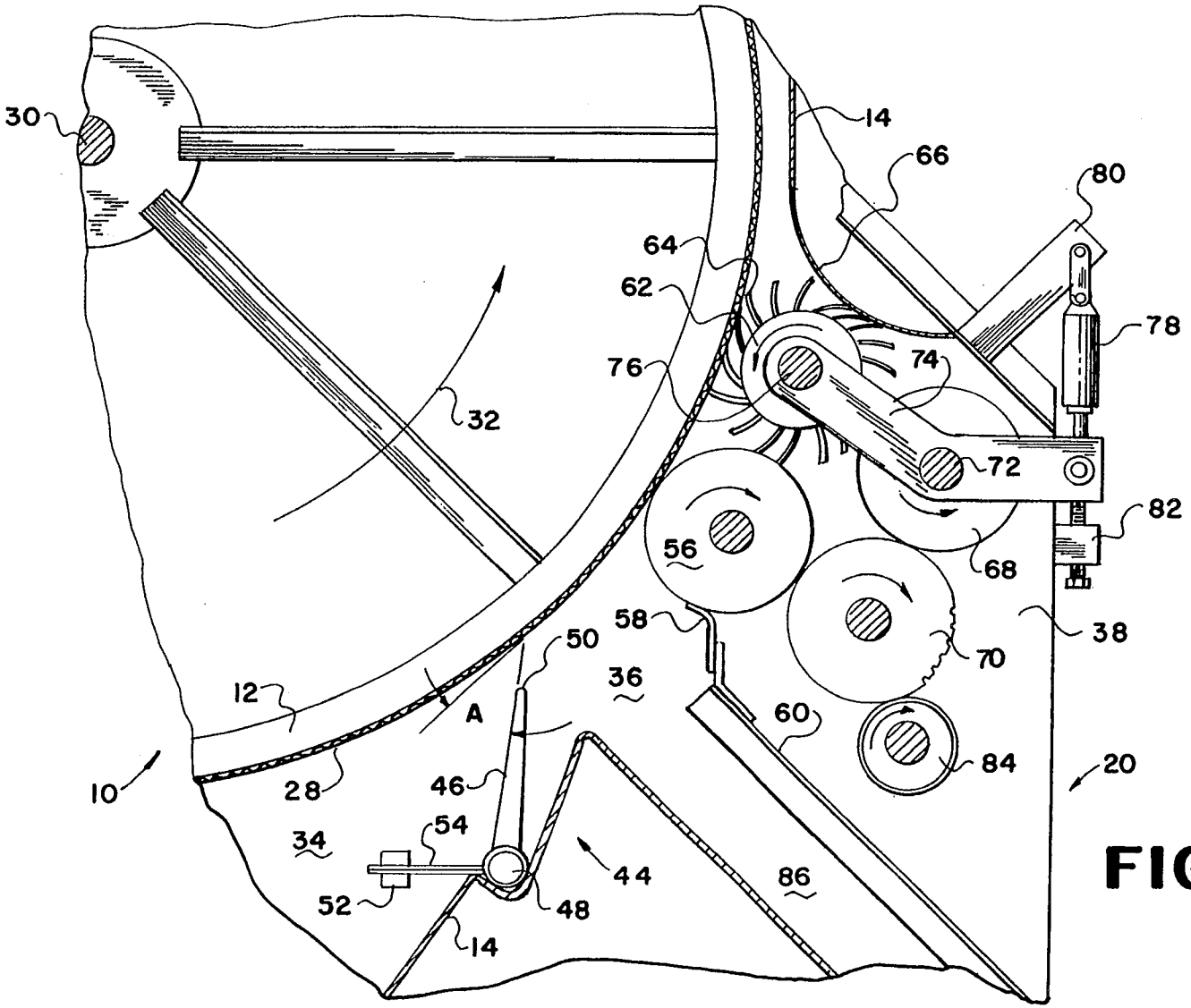
FIG. 2 is a enlarged portion of FIG. 1 showing the details of the doffing chamber.

Air valve 44 includes valve element 46, which is basically a rectangular plate having one edge attached to valve shaft 48. The valve shaft 48 is mounted to the housing 14 for rotary movement. The valve shaft 48 is parallel to the drum shaft 30. Distal edge 50 of the air valve rides against the batt upon the drum screen 28. The distal edge is held in contact with the lint batt by weight 52 mounted upon arm 54 attached to shaft 48. The arm 54 is horizontally oriented so that the distal edge has a substantially constant pressure against the batt. As may be seen the valve element 46 forms an angle of about 50° with a tangent of the screen 28 as shown by the angle "A" of FIG. 2. Thus an effective seal is formed between the lint inlet 34 and the humid air inlet 36.

Smooth doffing roller 56 is mounted for rotation about an axis parallel to the drum shaft 30. The cotton batt is compressed between the screen 28 and the smooth surface of the roller 56. This forms a portion of the seal between the humid air inlet and the doffing chamber. The remainder of the seal is formed by air flap 58 which is attached to lint slide surface 60.

Flap roller 62 is mounted for rotation about its axis which is also parallel to the drum shaft 30. The circumference of the flap roller has a plurality of flaps 64 thereon. These flaps are flexible and preferably made of two or three-ply of sulfur-blown synthetic rubber. The flaps will wipe against the screen 28 forming a portion of the seal between the doffing chamber 38 and the dry air inlet 40. The remainder of the seal is formed by the flaps 64 wiping across housing portion 66. The roller 62 also functions as a doffing roller, doffing the batt from the screen 28 of the drum 12.

As previously described the drum has rotations means 32 for rotating it in a counter-clockwise direction as seen in the drawings. Therefore it may be seen that the humid air inlet 36 is upstream from the doffing chamber 38. The lint inlet 34 is upstream from the humid air inlet 36. The dry air inlet 40 is upstream from the lint inlet 34 and the doffing chamber 38 is upstream from the dry air inlet 40. Stated otherwise, the doffing chamber 38 is downstream of the humid air inlet 36 which is downstream of the lint inlet 34 which is downstream of the dry air inlet 40 which is downstream from the doffing chamber 38.

The flaps 64 upon the flap roller 62 also wipe across the smooth roller 56 thereby forming a seal between the two doffing rollers as well as aiding in the prevention of cotton lint from accumulating on the smooth surface of the smooth roller 56.

Smooth compression roller 68 is mounted for rotation about its axis which is parallel to the drum shaft 30. Ribbed or grooved compression roller 70 is rotated about its axis which is parallel to the drum shaft 30. The doffed cotton batt from the drum 12 is fed from the doffing rollers 56 and 62 to the compression rollers 68 and 70. Shaft 72 of the smooth compression roller 68 is mounted upon arm 74 which is pivoted about shaft 76 of the flap doffing roller 62. Fluid cylinder 78 extends from leg 80 anchored the housing 14 to the distal end of the arm 74. By this means a predetermined pressure is applied to the lint batt between the compression rollers 68 and 70. Adjustable stop 82 attached to the housing 14 prevents the contact of the compression rollers 68 which otherwise would produce an irritating screech.

The compression rollers 68 and 70 are approximately the same diameter as the diameters of the doffing rollers 56 and 62. As previously stated, having a diameter of this amount prevents an excess of accumulation of lint upon them. Also, the flaps 64 wipe the surface of the compression roller 68 to prevent an accumulation of lint upon its surface. The compression roller 72 has a minimum clearance between its surface and the surface of smooth doffing roller 56 and also delivery roller 84. The delivery roller 84 has a relatively small diameter and is mounted for rotation about its axis which is also parallel to drum shaft 30.

Lint slide air chamber 86 is formed immediately below the lint slide 60. The lint slide surface 60 is sheet metal and therefore the chamber 86 is immediately below it and in thermal conductive relationship with the upper surface of the surface 60 and the lint slide 20.

The source of warm humid air is connected to lower portion or bottom 88 of the lint slide air chamber 86. Therefore the lint slide will be warmed by the warm humid air in the chamber 86. The top of the chamber 86 forms the humid air inlet 36. It will be noted that the width of the humid air inlet 36 is less than twice the thickness of the lint slide air chamber 86. The connection of the source of warm humid air to the lint slide is well known and not further described here, as is the connection of the source of warm dry air to the dry air inlet 40. The lint slide 20 may be open or closed at the option of the cotton gin operator.

A sensor is placed within the humid air inlet 36 for the purpose of regulating the temperature and degree of humidity in the warm air inlet. Such regulation controls and sensors are all well known to the art and within the skill of those in the art, and therefore are neither described nor shown in detail herein.

Also it will be understood that the amount of humid air delivered will be determined by the amount of moisture meant to be absorbed by the cotton batt and therefore the operation of this does not depend upon what the pressure drop through the batt would be. Likewise the amount of dry air delivered to the warm dry-air inlet would be dependent upon the drying desired and the operator would not be concerned about the pressure drop across the screen 28. Therefore the reference to about 85% of the air being the delivery air for delivering the lint from the lint cleaner 24 to the lint inlet 34, is merely a guide. The amount of delivery air would be more dependent upon the air produced by the lint cleaner operation and that necessary to satisfactorily deliver the lint. The relative relationships of the amount of air used to humidify and dry and deliver, as stated herein is more of a guide of what would be expected rather than as a limitation upon operation.

The embodiment shown and described above is only exemplary. I do not claim to have invented all the parts, elements or steps described. Various modifications can be made in the construction, material, arrangement, and operation, and still be within the scope of my invention.

The restrictive description and drawings of the specific example above do not point out what an infringement of this patent would be, but are to enable one skilled in the art to make and use the invention. The limits of the invention and the bounds of the patent protection are measured by and defined in the following claims.

I claim as my invention:

1. The procedure of operating a cotton gin having a) a condenser drum in b) a housing connected by c) a lint slide to d) a baling press, and e) rotation means for rotating the drum in an operating direction;

wherein the improved method comprises the following steps:

f) dividing the housing into four segments, then by g) rotating the drum i) depositing a lint batt upon the drum in a lint input segment, then ii) forcing humid air through the batt thereby adding moisture to the batt in a humid air segment, iii) doffing the moisturized batt from the drum in a doffing segment, and thereafter iv) drying the drum by warm dry air in a dry air segment; and h) restricting air flow from one segment to another segment.

2. The process as defined in claim 1 wherein the step of drying of the drum is accomplished by j) exposing about half the drum to the warm dry air.

3. The process of operating a cotton ginning gin having a) a condenser drum in b) a housing connected by c) a lint slide to d) a baling press, and e) rotation means for rotating the drum in an operating direction, f) a doffing chamber, g) two doffing rollers in said doffing chamber to doff the cotton from the condenser drum, and h) a lint inlet for conveying lint carried in a stream of delivery air to the condenser drum in the housing upstream from the doffing chamber:

wherein the improved method comprising the following steps:

i) supplying warm moist air to a moist air inlet upstream of the doffing chamber, thus j) forcing warm moist air through a batt adjacent to the doffing cylinders, k) preventing the warm moist air from mixing with conveying air conveying the lint to the lint inlet, l) supplying warm dry air to the condenser drum downstream of the doffing chamber, and m) preventing the warm dry air from mixing with the lint inlet.

4. The process as defined in claim 3 further comprising:

n) exposing about half the drum to the warm dry air in the step of drying the drum.

5. The process as defined in claim 3 further comprising:

n) supplying about 85% of the total air supplied with the lint at the lint inlet, o) supplying about 8% of the total air supplied as the moist warm air, and p) supplying about 7% of the total air supplied as the warm dry air.

6. The process as defined in claim 5 further comprising:

q) exposing about half the drum to the warm dry air in the step of drying the drum.

7. In a cotton gin having a) a condenser drum in b) a housing connected by c) a lint slide to d) a baling press, e) a doffing chamber on the housing, f) rotation means on the drum for rotating the drum in an operating direction, and g) a lint inlet in the housing upstream from the doffing chamber;

wherein the improved structure comprises:

h) a fixed air seal between the housing and drum upstream of the lint inlet, i) a moist air inlet in the housing upstream of the doffing chamber, j) a source of warm moist air connected to the moist air inlet, and k) an air valve between the housing and the drum upstream of the moist air inlet and downstream of the lint inlet.

8. The structure as defined in claim 7 further comprising:

l) a lint slide air chamber, m) said lint slide air chamber being a chamber beneath and in thermal conductive relationship to the lint slide, n) a conduit connecting the source of warm humid air to a lower portion of the lint slide air chamber, o) an upper portion of the lint slide air chamber being said inlet into the housing.

9. The structure as defined in claim 7 further comprising:

l) a warm dry air inlet through the housing downstream of the doffing chamber and upstream of the fixed air seal.

10. The structure as defined in claim 9 further comprising:

m) a smooth doffing roller in the doffing chamber, n ) a flap doffer in the doffing chamber, o) said flap doffer downstream from the smooth doffing roller, p) said flap doffer having flexible flaps which wipe across the condenser drum, q) said flexible flaps of said flap doffer also wiping across a portion of the housing therefore forming a seal between the condenser drum and the housing at the flap doffer.

11. The structure as defined in claim 10 further comprising:

r) said flexible flaps on the flap doffer also wiping the surface of said smooth doffer thereby forming an air seal between the doffing rollers.

12. The structure as defined in claim 10 further comprising:

r) an air seal between the lint slide and a smooth doffing roller, s) said moist air inlet being bounded on one side by the smooth doffing roller and being bounded on the other side by said air valve, t) wherein a distance between the smooth doffing roller and the air valve is no greater than twice a thickness of said moist air slide chamber.

13. The structure as defined in claim 10 further comprising:

r) two compression rollers attached to the doffing chamber, s) said compression rollers and said smooth doffing roller each having a diameter which is about equal to the others, t) said compression rollers being biased together to compress a batt, u) said compression rollers receiving the batt from the doffing rollers.

14. The structure as defined in claim 13 further comprising:

v) said flexible flaps on the flap doffer wiping across one of said compression rollers to wipe any cotton from the surface of said compression roller.

15. The structure as defined in claim 14 further comprising:

v) a delivery roller, w) said delivery roller having a diameter less than the diameter of the compression rollers, x) said delivery roller having a surface close to one of the compression roller thereby delivering the batt of the cotton from the compression roller.

16. The structure as defined in claim 15 wherein said fixed air seal is approximately opposite to the doffing chamber.

17. The structure as defined in claim 9 wherein said fixed air seal is approximately opposite to the doffing chamber.

18. The structure as defined in claim 7 wherein said warm dry air segment covers about half the drum.

19. In a cotton gin having a) a condenser drum in b) a housing connected by c) a lint slide to d) a baling press, e) the cotton batt is doffed from the drum in the doffing chamber segment wherein the improvement comprises:

f) said housing divided into segments so that a circumferential element of the drum is successively exposed to:

i) a lint inlet segment, ii) a moist air inlet segment, iii) a doffing chamber segment, and iv) a warm dry air segment;

whereby:

g) a cotton batt is formed on the condenser drum in the lint inlet segment, h) moist air is blown through the batt on the drum in the humid air segment, j) the cotton batt is doffed from the drum in the doffing chamber segment, k) the drum surface is dried in the warm dry air segment, l) a fixed air seal separating the lint inlet segment from the warm dry air segment, m) an air valve separating the warm moist air segment from the inlet segment, and n) a flap doffer separating the doffing chamber segment from the warm dry air segment;

o) said doffing chamber segment including:

i) a smooth doffing roller and said flap doffer, ii) a smooth compression roller, iii) a grooved compression roller, iv) a delivery roller, v) flexible flaps on said flap doffer wiping across the smooth doffer roller, the drum surface, the housing, and the smooth compression roller, vi) said compression rollers and said smooth doffing rollers each having a diameter which is about equal to the others, vii) said compression rollers biased together to compress a batt there between, and viii) said compression rollers receiving the batt from the doffing rollers, ix) the delivery roller having a diameter less than the diameter of the compression rollers, and x) the delivery roller having a surface close to the smooth doffing roller, p) a lint slide air chamber beneath and in thermal conductive relationship to the lint slide, q) a conduit connecting a source of warm humid air to a lower portion of the lint slide air chamber, and r) the upper portion of the lint slide air chamber forming the moist air segment.

* * * * *